United States Patent [19]

Mang

[11] 4,329,841

[45] May 18, 1982

[54] METHOD FOR THE PRODUCTION OF A SYNTHETIC CREPE YARN

[75] Inventor: Wilhelm Mang, Eschau, Fed. Rep. of Germany

[73] Assignee: Akzona Incorporated, Asheville, N.C.

[21] Appl. No.: 57,244

[22] Filed: Jul. 12, 1979

[30] Foreign Application Priority Data

Jul. 20, 1978 [DE] Fed. Rep. of Germany ..... 2831868

[51] Int. Cl.[3] ..... D02G 1/02

[52] U.S. Cl. ..... 57/288; 5/287; 5/284

[58] Field of Search ..... 57/204, 207, 254, 287, 57/288, 289, 293, 336, 284, 310

[56] References Cited

U.S. PATENT DOCUMENTS

| | | | |
|---|---|---|---|
| 3,874,159 | 4/1975 | MacFarlane | 57/288 |
| 3,955,351 | 5/1976 | Jones et al. | 57/288 X |
| 3,956,878 | 5/1976 | Schaffer et al. | 57/288 |
| 3,977,175 | 8/1976 | Yoshikawa et al. | 57/288 |
| 4,047,373 | 9/1977 | Takai | 57/336 |
| 4,164,838 | 8/1979 | Bach et al. | 57/288 X |
| 4,185,450 | 1/1980 | Moruzzi et al. | 57/288 X |

*Primary Examiner*—Donald Watkins

*Attorney, Agent, or Firm*—Francis W. Young; Tom R. Vestal

[57] ABSTRACT

The invention relates to a method for the production of synthetic filament yarn having crepe characteristics by simultaneous drawing and falsetwisting of the filament yarn while imparting a twist by means of a falsetwister, as well as—under certain conditions—drawing of the filament yarns to a ratio of at least 1:1.08.

7 Claims, 2 Drawing Figures

METHOD FOR THE PRODUCTION OF A SYNTHETIC CREPE YARN

Classical crepe yarn, e.g., of viscose filament yarn, is normally processed on a tier twister. Said machines permit process speeds of few meters per minute, and the yarns are thereby twisted up in one direction (i.e., S or Z), at e.g., 2000 to 3000 tpm. The resulting crepe yarns exhibit, as a rule, a high twist tendency detrimental in further processing of the yarn as well as a low breaking strength. However, they are distinguished by a dry hand and dull optics.

It has already been tried to produce yarns of crepe yarn characteristics on textile machines operating at higher speeds, in particular on falsetwist-texturing units. U.S. Pat. No. 3,009,309 describes a falsetwist-texturing process (air jet) for the production of a high twist yarn with alternating S and Z turns having the appearance of crepe yarn (cf. FIG. 40 and FIG. 32-col. 11, line 57 to col. 12, line 4 and Example 54, col. 21/22). Even though the patent (in Example 23, col. 19/20) refers to simultaneous draw-texturing with other yarn treatments—the process is based on a previously drawn yarn.

West German Patent disclosure No. 22 62 448 also describes a process for high twist yarns according to a falsetwisting process, whereby the yarns exhibit reciprocally alternating zones with S and Z twists, which are set in succession in the yarn (cf. FIG. 4).

This process, too, is based on separate drawing of the yarn at reduced draw ratio (so-called "partial drawing"). To obtain products of the desired type, such separate partial drawing requires considerable know-how, varying substantially from denier to denier and from spinning speed to spinning speed. In the process according to West German Patent disclosure No. 22 62 448 as in the process of U.S. Pat. No. 3,009,309 separate drawing and falsetwist texturing are especially detrimental.

U.S. Pat. No. 4,033,103 also describes a process for the production of a synthetic filament yarn with crepe yarn characteristics whereby a polyethylene terephthalate filament yarn spun at 2000 mpm with setting of the false twist imparted by a falsetwister and in conjunction with drawing of the filament yarn to a ratio of about 1:2.35 is simultaneously subjected to a draw-falsetwisting treatment. By continuously changing the yarn tensions (with an intermittently acting blocking element) the yarn has alternating thick and thin, i.e., bulky and twisted, spots, whereby the bulky, i.e., truly textured, spots may be as long or longer than one meter.

The subject matter of the invention is to make available—while taking advantage of the simultaneous draw-falsetwisting treatment (i.e., integrated drawing and textile treatment; significant increase in processing speed by a factor of 10 to 20 compared with tier twisting) a process to manufacture from synthetic filament yarn uptwisted crepe yarns with alternating S and Z turns, which compared with classical crepe yarns have a reduced, and in particular, an infinitely variable twist tendency as well as better textile-technological properties (breaking strength, breaking elongation). Moreover, the process may be carried out without changing, i.e., converting, the technical elements of well-known falsetwist texturing equipment.

These objectives as well as those outlined in the further description are met by the above-mentioned process in that to obtain a high twist crepe yarn of reduced twist tendency the draw ratio compared to that of draw-falsetwist texturing used for crimped yarns is—depending on degree of preorientation—reduced by at least 0.3.

If, for instance, a polyethylene terephthalate yarn spun at 1200 mpm is drawn to a ratio of 1:3.35 by conventional simultaneous draw-falsetwist texturing, the drawing according to the invention should be proportionally smaller than 1:3.05 (e.g., 1:2.70).

A reduction in draw ratio will entail a reduction—in absolute terms—of the yarn tensions and their ratio to each other will be increased.

Identifying the yarn tension measured in the cooling zone between setting unit and falsetwister (some 15 cm above the falsetwister) as $S_1$ and the yarn tension measured after the falsetwister, but before the draw off godets as $S_2$, $S_1$ should preferably be smaller than 2 cN/tex and the ratio $S_2$:$S_1$ greater than 2.2.

By contrast with the process in West German Patent disclosure 24 11 074 where, as a result of bunching twist in front of the intermittently acting blocking device there is only periodic twist slippage, under the above described conditions there is, according to the invention, a continuous twist slippage leading to alternating S and Z twists without intermediate textured zones.

Depending on denier, the number of imparted turns per meter is 800 to 6300. The number of turns per meter imparted to the filament yarn should preferably be between 1000 and 4000. Accordingly, the yarn of the invention lies—in terms of turns—within the range of classical crepe yarns; however, it has the advantage of a lower twist tendency and better textile-technological properties, in particular higher breaking strength,—due to the use of synthetic starting materials—e.g., easy care properties, greater comfort, and in particular, higher breaking strength. The number of imparted turns per meter, according to the invention, is some 10 to 40% lower than the level used in the production of crimped yarn by conventional draw-falsetwist-texturing.

The process of the invention can be carried out with conventional thermoplastic polymers, especially polyamides such as polycaprolactam, polyhexamethylene adipic acid amide and similar polyamides used in the textile field, and polyethylene, polypropylene and related products, polyacrylonitrile, etc.

By preference, the filament yarn used in the process is polyester, in particular polyethylene terephthalate.

In particular, filament yarns spun at draw-off speeds of 1200 to 3500 mpm can be used in the process. These yarns should be drawn at a ratio of about 1:2.85 (1200 mpm material) to 1:1.1 (3500 mpm material), but filament yarns spun at higher speed will also lead to the desired synthetic crepe.

The twist imparted by the falsetwister should be set in the case of polyester yarns at temperatures between 200° and 240° C., preferably between 210° and 235° C. Higher temperatures will cause, to some extent, sticking of individual filaments to each other, leading to an undesirable harsh hand in the goods.

The yarn emerging from the drawing zone can be taken up immediately. But, preferably, the alternating S and Z turns are set to obtain a more uniform loop picture after processing to loop goods and to eliminate the typical "flash effects" of crepe yarns. To this end, the twisted crepe yarn should be subjected to a thermal treatment below 210° C., preferably between 170° and 200° C. on emerging from the drawing zone.

The process of the invention can be carried out on conventional falsetwist-crimping machines with one or two heaters. The falsetwist units can be external or internal friction units, preferably the falsetwist unit is a falsetwisting spindle equipped with a deflection pin or a multidisk friction unit, providing a more uniform yarn appearance.

BRIEF DESCRIPTION OF THE DRAWINGS

The invention is explained on hand of the enclosed drawings wherein.

DETAILED DESCRIPTION OF THE DRAWINGS

Figure 1:
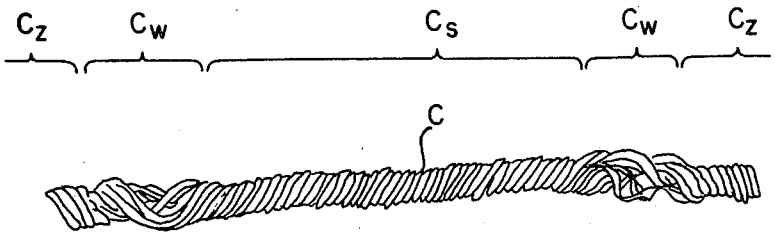
FIG. 1 is a 35× magnification of a typical segment of crepe yarn obtained according to the invention.

FIG. 1 shows that the crepe yarn C obtained according to the invention has, alternating in short periods, segment $C_s$ with S turns and segment $C_z$ with Z turns. In the $C_w$ zone, there is always a change in the direction of the turns. In a typical product of the invention in a yarn segment of 0.5 m length, the average length of the $C_s$ segments is about 2.9 mm (from 0.3 to 7.5 mm) and the average length of the $C_z$ segments about 4.1 mm (from 0.4 to 8.5 mm). At a falsetwister setting of 3200 tpm the twist density is between 2600 and 2900 tpm.

Figure 2:
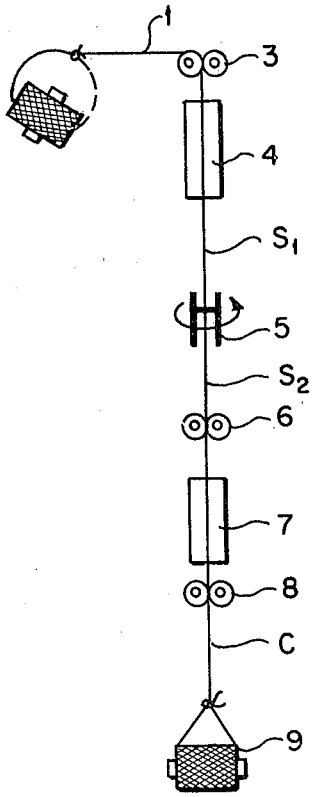
FIG. 2 is a schematic of a dual heater falsetwist-crimping machine which can be used to carry out the process of the invention.

In FIG. 2, the filament yarn 1 is drawn off feeder spool 2 and travels via godets 3 to a drawing zone with heater 4 and a falsetwister 5. The twisted yarn, with alternating S and Z turns, travels from draw-off godets 6, preferably first to a setting zone with heater 7, before advancing via relaxation godet 8 to take up unit 9 as finished crepe yarn C. Draw-off godets 6 rotate according to the draw ratio more rapidly than godets 3; the relaxation rolls 8 are driven at slightly lower speed than draw-off godets 6. $S_1$ and $S_2$ represent the yarn tension measuring points.

EXAMPLE I

An 18 filament polyethylene terephthalate yarn of dtex 50 nominal denier spun at 3500 mpm is processed on a dual heater falsetwist-crimping machine type Barmag FK5C. Spindle speed is 420,000 rpm, twist level 3700 tpm, draw ratio 1:1.1, heater temperatures 230° C./210° C. The ratio of the circumferential speeds of draw-off godets, relaxation rolls and take-up is 100:98:96. Yarn tensions are $S_1$=4.1 cN and $S_2$=10.6 cN.

The crepe yarn denier is 53.2 dtex, the strength 31.1 cN/tex, elongation 28.8%, boiling shrinkage 3.2%, hot air shrinkage 4.9%. Twist tendency per meter is 22.

EXAMPLE II

This example outlines the influence of the draw ratio. A 24 filament bright, non-circular polyethylene terephthalate dtex 76 nom. denier yarn spun at 2000 mpm is treated at the following machine settings: spindle speed=400,000 rpm, twist level=2900 tpm, heater temperatures=232° C./190° C., speed ratio of draw-off godets, relaxation rolls and takeup=100:98:96.

The draw ratio is varied as shown in Table I, resulting in the listed textile data. Whereas the starting yarn is normally (i.e., in the production of crimped yarns) drawn to a ratio of 1:2.3, at a draw ratio lowered to 1:2.0 or less, the desired crepe character is obtained.

EXAMPLE III

A yarn similar to Example II is treated at the following machine settings: spindle speed=400,000 rpm, heater temperatures 232° C./190° C.; speed ratio of draw-off godets, relaxation rolls and takeup=100:98:96; draw ratio=1:1.82. A twist with a variable number of turns per meter is imparted. The influence of these parameters is outlines in Table II.

TABLE I

| | Draw Ratio | | | | | |
|---|---|---|---|---|---|---|
| Textile Data | 1:1.8 | 1:1.9 | 1:2.0 | 1:2.1 | 1:2.2 | 1:2.3 |
| Denier (dtex) | 95.6 | 89.0 | 86.6 | 81.4 | 78.7 | 75.9 |
| Strength (cN/tex) | 22.9 | 24.3 | 24.1 | 25.4 | 25.7 | 25.9 |
| Elongation (%) | 45.8 | 35.9 | 30.1 | 24.0 | 20.9 | 16.1 |
| Boiling Shrinkage (%) | 3.8 | 4.2 | 4.1 | 4.3 | 4.5 | 4.3 |
| Hot Air Shrinkage (%) | 4.7 | 5.9 | 6.0 | 5.9 | 6.4 | 6.4 |
| Twist Tendency ($m^{-1}$) | 23 | 30 | 31 | 26 | 25 | 27 |
| Yarn Tension $S_1$ (cN) | 6 | 7.6 | 8.3 | 10.9 | 13.1 | 15.4 |
| Yarn Tension $S_2$ (cN) | 15.8 | 18.3 | 18.9 | 22.6 | 25.7 | 30.8 |
| | 2.62 | 2.40 | 2.28 | 2.07 | 1.96 | 2.00 |
| Hand | Crepe-like ← | | | | → Soft | |
| Bulk | Decreasing ← | | | | → Increasing | |
| Optics/Loop Appearance | Uniform Crepe-Like ← | | | | → Textured Yarn | |

TABLE II

| | Turns per Meter | | | |
|---|---|---|---|---|
| Textile Data | 2000 | 2300 | 2900 | 3200 |
| Denier (dtex) | 95.1 | 95.8 | 93.6 | 97.7 |
| Strength (cN/tex) | 24.7 | 22.9 | 24.0 | 22.5 |
| Elongation (%) | 45.6 | 45.7 | 45.3 | 42.8 |
| Boiling shrinkage (%) | 2.9 | 3.2 | 3.9 | 4.1 |
| Twist tendency ($m^{-1}$) | 28 | 24 | 29 | 24 |
| $S_1$ (cN) | — | 5.4 | 6.2 | 6.5 |
| $S_2$ (cN) | — | 16.0 | 15.7 | 15.0 |
| $S_1$:$S_2$ | — | 2.97 | 2.54 | 3.30 |
| Hand | Harsh Crepe-Like ← | | | → Dry Crepe-Like |
| Bulk | Increase ← | | | → |
| Optics/loop appearance | Flat Synth. Crepe-Like ← | | | → Uniform Crepe-Like |

What is claimed is:

1. A process for making a highly twisted crepe effect yarn of reduced twisting tendency comprising the steps in a simultaneous draw-falsetwisting process of feeding a yarn of synthetic polymeric filaments to a first heating zone and heating the yarn to below its melting point; directing the yarn to a falsetwisting device and backing the twist thereby imparted up to said first heating zone; and drawing yarn from the falsetwist device at a speed at least 1.08 times the determined first speed, the improvement comprising maintaining the yarn tension $S_1$, before the falsetwist device less than 2 cN/tex and the ratio of yarn tension after the falsetwist device $S_2$ to $S_1$ ($S_2/S_1$) greater than about 2.2, drawing yarn from the falsetwist device at a ratio at least about 0.3 less than the drawing ratio for conventional bulk-textured yarns and falsetwisting the yarn 10–40 percent less than the twist level for conventional bulk-textured yarns.

2. The process of claim 1, wherein the number of turns the yarn is falsetwisted is between 800 to 6300 turns per meter.

3. The process of claim 2, wherein the number of turns per meter is 1000 to 4000.

4. The process of claim 1, wherein the filament yarn is polyester meltspun at a winding speed of 1200 to 3500 meters per minute, the drawing speed is between 1:2.85 and 1:1.1 times the determined first speed, and the yarn is heated in the first heating to between 200°–240° C.

5. The process of claim 4, wherein the yarn is heated between 210°–235° C.

6. The process of claim 4 wherein the yarn is heated in a second zone after the falsetwisting device to a temperature less than 210° C.

7. The process of claim 6, wherein the second zone temperature heating is between 120°–210° C.

* * * * *